US008995890B2

(12) United States Patent
Maruyama et al.

(10) Patent No.: US 8,995,890 B2
(45) Date of Patent: Mar. 31, 2015

(54) DEVELOPING DEVICE AND IMAGE FORMING APPARATUS HAVING MAGNETIC POLES TO CONTROL THE DISTRIBUTION OF A MAGNETIC ATTRACTION FORCE

(71) Applicant: Fuji Xerox Co., Ltd., Tokyo (JP)

(72) Inventors: Akihisa Maruyama, Kanagawa (JP); Toshihiro Kanematsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 128 days.

(21) Appl. No.: 13/849,881

(22) Filed: Mar. 25, 2013

(65) Prior Publication Data

US 2014/0029986 A1 Jan. 30, 2014

(30) Foreign Application Priority Data

Jul. 24, 2012 (JP) ..... 2012-163602

(51) Int. Cl.
*G03G 15/09* (2006.01)
*G03G 15/01* (2006.01)

(52) U.S. Cl.
CPC ..... *G03G 15/0921* (2013.01); *G03G 15/0189* (2013.01)
USPC ..... 399/277

(58) Field of Classification Search
CPC ..... G03G 15/0921
USPC ..... 399/267, 276, 277
See application file for complete search history.

(56) References Cited

U.S. PATENT DOCUMENTS

| | | | | |
|---|---|---|---|---|
| 4,911,100 | A * | 3/1990 | Yamashita | 399/277 |
| 5,446,526 | A * | 8/1995 | Shimizu | 399/276 |
| 8,126,379 | B2 * | 2/2012 | Hayase et al. | 399/277 |

FOREIGN PATENT DOCUMENTS

JP A-2005-115115 4/2005

* cited by examiner

*Primary Examiner* — William J Royer
(74) *Attorney, Agent, or Firm* — Oliff PLC

(57) ABSTRACT

A developing device includes a developing member including a magnet member on which plural magnetic poles including a developing main magnetic pole are magnetized in a circumferential direction and a developer holder that faces an image supporting member, receives the magnet member, and holds a developer, wherein a distribution of a magnetic attraction force in a circumferential direction has a gradient that increases toward a downstream end from an upstream end of a developing area in a developer transport direction of the developer holder, and the magnetic poles are magnetized on the magnet member so that the amount of the increase of the magnetic attraction force between the upstream end and a middle position of the developing area is larger than that between the middle position and the downstream end.

5 Claims, 17 Drawing Sheets

DEVELOPING DEVICE AND IMAGE FORMING APPARATUS HAVING MAGNETIC POLES TO CONTROL THE DISTRIBUTION OF A MAGNETIC ATTRACTION FORCE

CROSS-REFERENCE TO RELATED APPLICATIONS

This application is based on and claims priority under 35 USC 119 from Japanese Patent Application No. 2012-163602 filed Jul. 24, 2012.

BACKGROUND (i) Technical Field

The present invention relates to a developing device and an image forming apparatus.

(ii) Related Art

A two-component developer, which includes toner and a magnetic carrier, is often used in an image forming apparatus that forms a visible image by transferring toner to an electrostatic latent image formed on an image supporting member.

Such a two-component developer is magnetically adsorbed on the peripheral surface of a roll-shaped developing member of a developing device, that is, a developing roll, and is transported to a position facing the image supporting member. Further, toner is transferred to an electrostatic latent image, which is formed on the image supporting member, in an electric field that is formed by applying a developing bias voltage between the image supporting member and the developing roll. As a result, a visible image is formed.

SUMMARY

According to an aspect of the invention, there is provided a developing device including a developing member including a magnet member on which plural magnetic poles including a developing main magnetic pole are arranged and magnetized in a circumferential direction, and a cylindrical developer holder that is disposed so as to face an image supporting member, receives the magnet member, and holds to transport a developer, wherein the distribution of a magnetic attraction force, which is applied on a peripheral surface of the developer holder in a developing area in a direction perpendicular to the peripheral surface by the magnet member, in a circumferential direction has a gradient that increases toward a downstream end from an upstream end of the developing area in a developer transport direction of the developer holder, and the plural magnetic poles are magnetized on the magnet member so that the amount of the increase of the magnetic attraction force between the upstream end of the developing area and a middle position of the developing area is larger than the amount of the increase of the magnetic attraction force between the middle position and the downstream end.

BRIEF DESCRIPTION OF THE DRAWINGS

Exemplary embodiments of the present invention will be described in detail based on the following figures, wherein:

FIGS. 5A and 5B are views showing the distribution of magnetic flux density and the distribution of a magnetic attraction force on the peripheral surface of a developing roll B that is used in a developing device used in the experiment as a comparative example;

DETAILED DESCRIPTION

Exemplary embodiments of the invention will be described with reference to the drawings.

Figure 1:
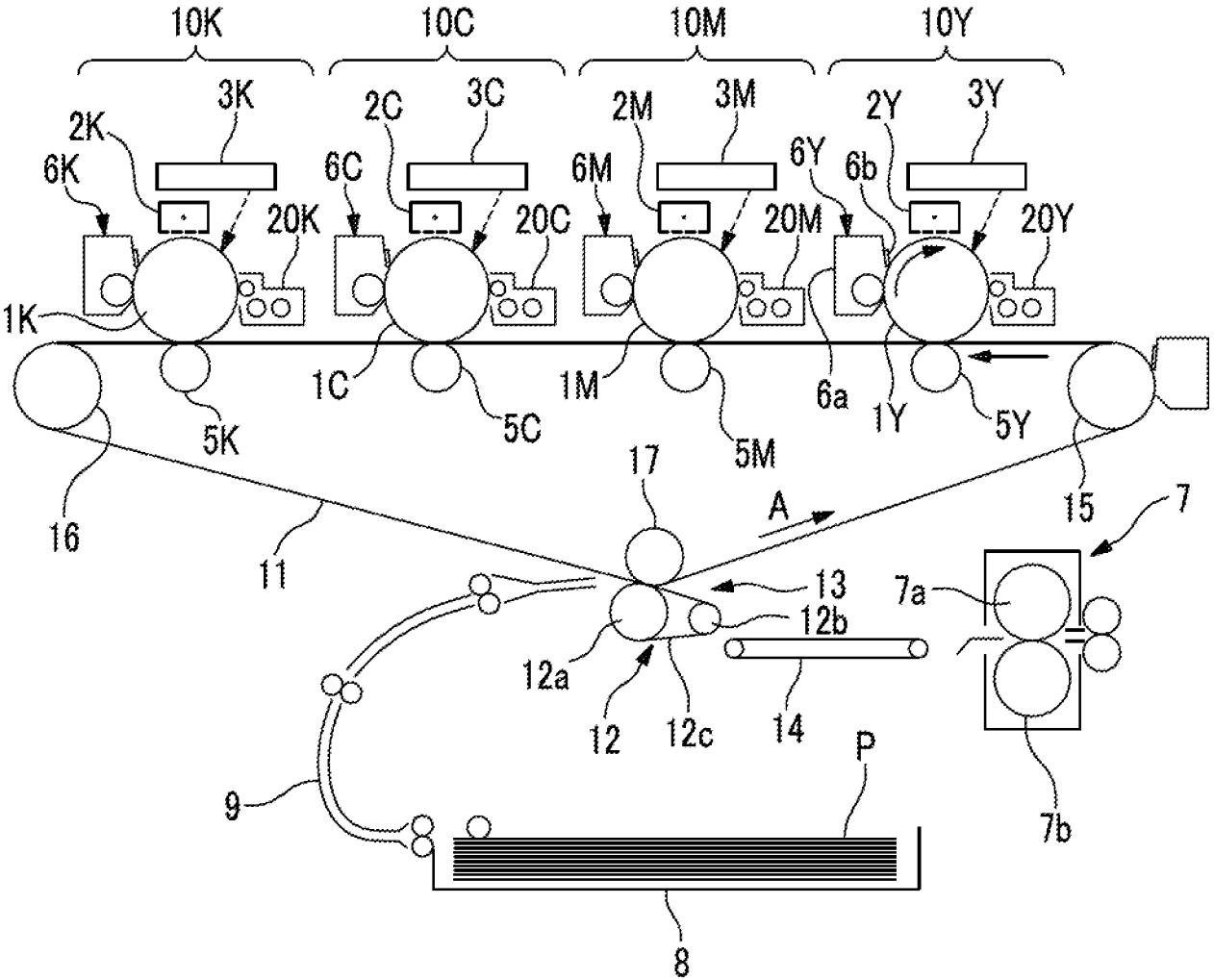
FIG. 1 is a schematic view showing the structure of an image forming apparatus that is an exemplary embodiment of the invention.

FIG. 1 is a schematic view showing the structure of an image forming apparatus that is an exemplary embodiment of the invention.

This image forming apparatus is an image forming apparatus that forms a color image using four color toners. The image forming apparatus includes electrophotographic image forming units 10Y, 10M, 10C, and 10K that output a yellow (Y) image, a magenta (M) image, a cyan (C) image, and a black (K) image and an intermediate transfer belt 11 that faces the image forming units 10Y, 10M, 10C, and 10K.

The intermediate transfer belt ii is stretched by a driving roll 15 that is rotationally driven, an adjusting roll 16 that adjusts the deviation of the intermediate transfer belt 11 in a width direction, and a counter roll 17. Further, the intermediate transfer belt 11 is disposed so as to face the image forming units 10Y, 10M, 10C, and 10K, and the peripheral surface of the intermediate transfer belt 11 is rotationally driven in the direction of an arrow A shown in FIG. 1.

The image forming unit 10Y that forms a yellow toner image, the image forming unit 10M that forms a magenta toner image, the image forming unit 10C that forms a cyan toner image, and the image forming unit 10K that forms a black toner image are arranged in this order from the upstream side in the direction in which the intermediate transfer belt 11 is rotationally moved. A secondary transfer member 12, which performs secondary transfer, is disposed on the downstream side of the image forming units 10Y, 10M, 10C, and 10K so as to come into contact with the intermediate transfer belt 11 and so as to face the counter roll 17.

A recording sheet P, which is a recording medium, is sent to a secondary transfer position 13 where the secondary transfer member 12 faces the intermediate transfer belt 11 from a recording sheet accommodating unit 8 via a transport path 9. A device 14, which transports a recording sheet P to which the toner images have been transferred, and a fixing device 7, which press-bonds the toner images to the recording sheet P by heating and pressing the toner images, are provided on the downstream side of the secondary transfer position 13 in a recording sheet transport path.

A discharged sheet holding unit (not shown), which stacks and holds the recording sheets P to which the toner images have been fixed, is provided further away on the downstream side.

Each of the image forming units 10Y, 10M, 10C and 10K includes a photoreceptor drum 1Y, 1M, 1C and 1kK where an electrostatic latent image is formed on the surface and which functions as an image supporting member. Each of the image forming units 10Y, 10M, 10C and 10K includes a charging device 2Y, 2M, 2C and 2K, a developing device 20Y, 20M, 20C and 20K, a primary transfer roll 5Y, 5M, 5C and 5K, and a cleaning device 6Y, 6M, c and 6K that are provided around the photoreceptor drum 1Y, 1M, 1C and 1K. The charging device 2Y, 2M. 2c and 2K charges the surface of the photoreceptor drum 1Y, 1M, 1C and 1K. The developing device 20Y, 20M, 20C and 20K forms a toner image by selectively transferring toner to the latent image formed on the photoreceptor drum 1Y, 1M, 1C and 1K. The primary transfer roll 5Y, 5M, 5C and 5K primarily transfers the toner image, which is formed on the photoreceptor drum 1Y, 1M,1C and 1K, to the intermediate transfer belt 11. The cleaning device 6Y, 6M, 6C and 6K removes toner that remains on the photoreceptor drum 1Y, 1M, 1C and 1K after transfer. Further, an exposure device 3Y, 3M, 3C and 3K, which generates image light on the basis of an image signal, is provided for each of the photoreceptor drums 1Y, 1M, 1C and 1K. Each of the photoreceptor drums 1Y,1m, 1C and 1K is irradiated with the image light generated from the exposure device 3Y, 3M, 3C,and 3K so that an electrostatic latent image is written on the charged photoreceptor drum 1Y, 1M, 1C and 1K. In this exemplary embodiment, the photoreceptor drum 1Y, 1M, 1C and 1K is charged with a voltage of −800 V by the charging device 2Y, 2M, 2C and 2K and the surface potential of an exposed image portion is attenuated so as to be set to be −400 V.

The photoreceptor drum 1Y, 1M, 1C and 1K is formed by laminating a photosensitive layer on a base body that has an endless peripheral surface and is made of conductive metal, and the peripheral surface of the photoreceptor drum 1Y, 1M, 1C and 1K is rotationally moved. The photosensitive layer is a function separation type layer where a charge generation layer and a charge transport layer are sequentially laminated. The photosensitive layer has a property where the specific resistance of the irradiated portion changes when the photosensitive layer is irradiated with a laser beam by the exposure device 3Y, 3M, 3C and 3K.

The developing device 20Y, 20M, 20C and 20K uses a two-component developer that includes toner and a magnetic carrier. Further, the developing device 20Y, 20M, 20C and 20K forms the toner image into a visible image by transferring the toner of the two component developer to the exposed portion of the surface of the photoreceptor drum 1Y, 1M, 1C and 1K at the position facing the photoreceptor drum 1Y, 1M, 1C and 1K.

The cleaning device 6Y, 6M, 6C and 6K is disposed so as to face the peripheral surface of the photoreceptor drum 1Y, 1M, 1C and 1K, and includes a cleaner housing 6*a* that includes an opening at the position facing the photoreceptor drum 1Y, 1M, 1C and 1K. Moreover, a cleaning blade 6*b* is provided so as to be supported by the cleaner housing 6*a* and so as to come into contact with the peripheral surface of the photoreceptor drum 1Y, 1M,1C and 1K.

A so-called blade pressure method where an edge portion of the end of the cleaning blade 6*b* comes into contact with the surface of the photoreceptor drum 1Y, 1M, 1C and 1K is employed in this exemplary embodiment, so that toner and the like remaining on the photoreceptor drum 1Y, 1M, 1C and 1K after primary transfer is scraped off and removed.

The secondary transfer member 12, which is disposed at the position facing the counter roll 17 with the intermediate transfer belt 11 interposed between the counter roll 17 and the secondary transfer member 12, includes a secondary transfer roll 12*a*, an auxiliary roll 12*b*, and a secondary transfer belt 12*c* that is stretched by the secondary transfer roll 12*a* and the auxiliary roll 12*b*. The secondary transfer belt 12*c* is interposed between the counter roll 17 and the secondary transfer roll 12*a* while overlapping the intermediate transfer belt 11, and is rotationally moved as the intermediate transfer belt 11 is rotationally driven. Further, when a recording sheet P is sent to a gap between the intermediate transfer belt 11 and the secondary transfer belt 12*c*, the recording sheet P is transported while being interposed. Furthermore, a secondary transfer voltage is applied to the counter roll 17 in order to form an electric field for transfer between the secondary transfer roll 12*a* and the counter roll 17.

The fixing device 7 includes a heating roll 7*a* in which a heating source is built and a pressure roll 7*b* that comes into press contact with the heating roll 7*a*, and forms a nip portion where the heating roll 7*a* and the pressure roll 7*b* come into contact with each other. The recording sheet P to which the toner image has been transferred is sent to the nip portion and is heated and pressed between the pressure roll 7*b* and the heating roll 7*a* that is rotationally driven. Accordingly, the toner image is press-bonded to the recording sheet P.

Figure 2:
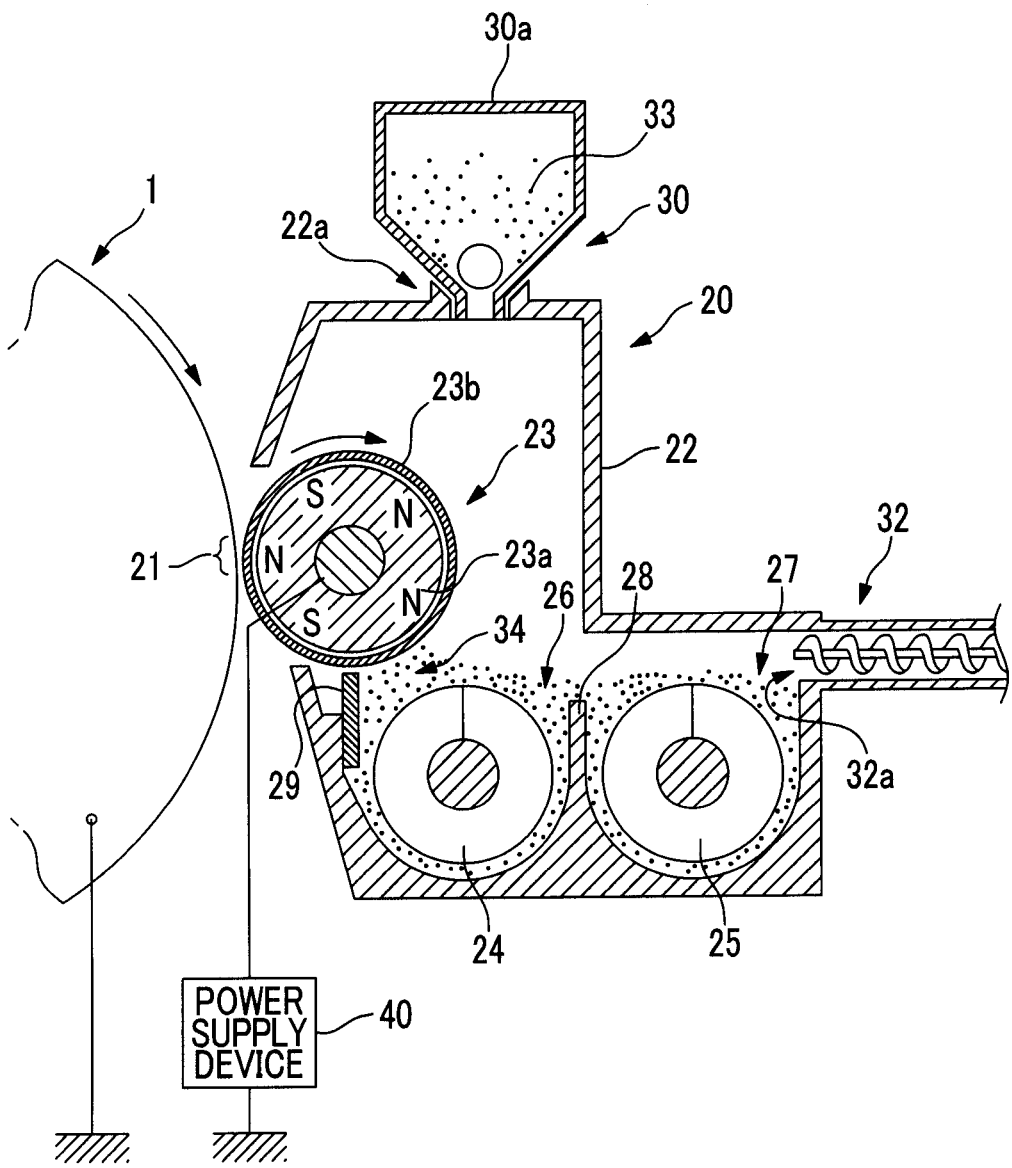
FIG. 2 is a schematic view showing the structure of a developing device of the image forming apparatus that is the exemplary embodiment of the invention and is shown in FIG. 1.

FIG. 2 is a cross-sectional view of a developing device 20.

The developing device 20 includes a housing 22 that includes developer storage chambers 26 and 27 storing a two-component developer, a developing roll 23 that is a developing member disposed close to a photoreceptor drum 1 so as to face the photoreceptor drum 1, first and second augers 24 and 25 that stir the two-component developer in the housing 22 and transport the two-component developer, a developer replenishing unit 30 that replenishes the housing 22 with the two-component developer, a recovery portion 32 that recovers the two-component developer present in the housing 22, and a thickness regulating member 29 that regulates the amount of the two-component developer adsorbed on the developing roll 23.

A two-component developer, which includes one kind of toner among yellow toner, magenta toner, cyan toner, and black toner, is stored in the housing 22. Further, a portion of the housing 22, which faces the photoreceptor drum 1, is opened and the developing roll 23 is disposed at this portion so as to be close to the photoreceptor drum 1 so as to face the photoreceptor drum 1.

The two-component developer, which is stored in the housing 22, includes toner and a magnetic carrier. The toner is obtained by forming a material, which is formed by kneading a thermoplastics resin and a color material, into powder. The magnetic carrier is formed by forming a covering layer on a granular material that is formed by kneading ferrite and a synthetic resin.

Toner of which the particle size is in the range of about 3 μm to 9 μm and a magnetic carrier of which the volume average particle size is in the range of about 20 μm to 50 μm are used.

The developing roll 23 includes a magnet roll 23*a* and a sleeve 23*b*. The magnet roll 23*a* has plural magnetic poles in the circumferential direction and is fixedly supported. The sleeve 23*b* is a non-magnetic hollow cylindrical member rotatably supported around the magnet roll 23*a* and functions as a developer holder. Further, the developing roll 23 magnetically adsorbs a two-component developer on the outer peripheral surface of the sleeve 23*b*, and is adapted so as to be capable of transporting the two-component developer in the circumferential direction by the rotational driving of the sleeve 23*b*.

The first and second augers 24 and 25 are provided in the two developer storage chambers 26 and 27 that are provided behind the position where the developing roll 23 is disposed in the housing 22. These first and second augers 24 and 25 include spiral blades around support shafts, and are supported so that the axes of the first and second augers 24 and 25 are parallel to the axis of the developing roll 23. These first and second augers 24 and 25 transport the two-component developer in the axial direction while stirring the two-component developer by rotating about the axes. The first and second augers 24 and 25 transport the two-component developer in the directions opposite to each other. Further, the developer storage chambers 26 and 27 are partitioned by a partition wall 28 that is provided between themselves and communicate with each other at both end portions thereof. Accordingly, the two-component developer transported by the first and second augers 24 and 25 is stirred in the developer storage chambers 26 and 27 and is transported so as to circulate in the two developer storage chambers 26 and 27.

The developer replenishing unit 30 includes a replenishing port 22*a* that is formed at the upper portion of the housing 22 and a replenishing cartridge 30*a* that is mounted on the replenishing port 22*a*. The replenishing cartridge 30*a* is detachably mounted on the replenishing port 22*a*. Further, as a developing operation is repeatedly performed, a developer 33 for replenishment stored in the replenishing cartridge 30*a* is supplied into the housing 22.

Meanwhile, it is possible to control the replenishment of the two-component developer so that a required amount of the two-component developer is replenished at an appropriate timing according to the consumption of toner, the amount of developed images, the concentration of the toner present in the housing 22, the amount of charge of the magnetic carrier, and the like.

The recovery portion 32 includes an outlet 32*a* through which the two-component developer present in the housing 22 is discharged to the outside of the housing 22, and communicates with a storage container (not shown) that stores the discharged developer. The housing 22 is replenished with the two-component developer, so that surplus two-component developer is discharged from the inside of the housing 22. Accordingly, the recovery portion 32 may adjust the amount of the developer present in the housing 22.

Meanwhile, the discharge of the developer may be performed for a two-component developer that is deposited at a height higher than a predetermined height, and may be controlled so as to be performed at a predetermined timing like the replenishment of a developer for replenishment.

The thickness regulating member 29 is provided on the downstream side of a developer supply area 34 where the developing roll 23 and the first auger 24 face each other in the rotation direction of the developing roll 23, and is disposed so as to be spaced from the surface of the sleeve 23*b*. The thickness regulating member 29 is formed of a metal plate, and regulates the amount of passed magnetic carrier that is magnetically adsorbed on the sleeve 23*b* in the shape of an ear of grain so that the adjusted amount of the two-component developer is adsorbed on the sleeve 23*b*.

A developing bias voltage is applied between the developing roll 23 and the photoreceptor drum 1 from a power supply device 40. Further, an electric field is formed between the photoreceptor drum 1 and the developing roll 23 in a developing area 21 where the photoreceptor drum 1 and the developing roll 23 face each other, and toner having charge is transferred to the image portion formed on the photoreceptor drum 1 in this electric field.

Here, the developing area 21 is defined as follows:

The magnetic carrier of the two-component developer is adsorbed on the sleeve 23*b* by a magnetic force of the magnet roll 23*a* so as to be continuous in the shape of an ear of grain and the magnetic carrier having the shape of an ear of grain comes into contact with the peripheral surface of the photoreceptor drum 1, so that development is performed. In this exemplary embodiment of the invention, a range where the magnetic carrier standing on the sleeve 23*b* in the shape of an ear of grain comes into contact with the photoreceptor drum 1 is referred to as the developing area 21.

Figure 3A:
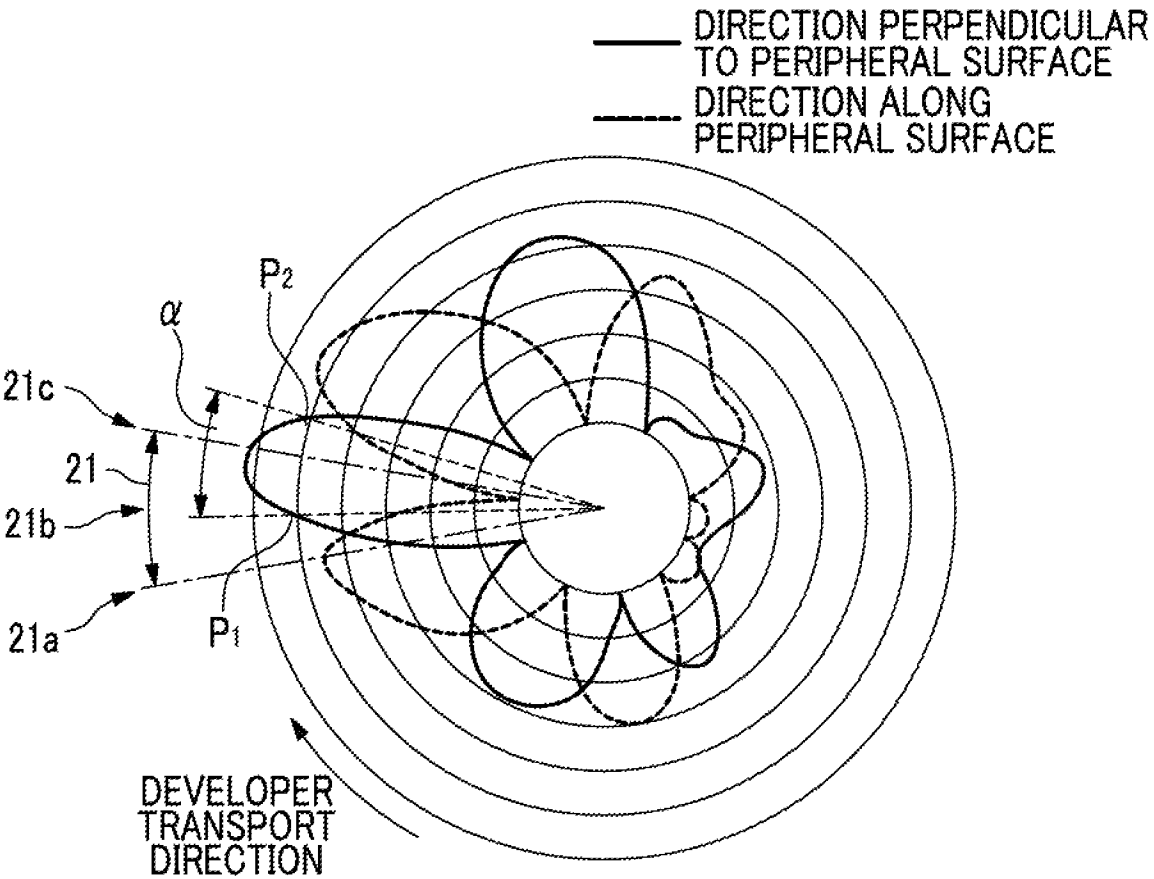
FIGS. 3A and 3B are views showing the distribution of magnetic flux density and the distribution of a magnetic attraction force on the peripheral surface of a developing roll of the developing device shown in FIG. 2.
Figure 3B:
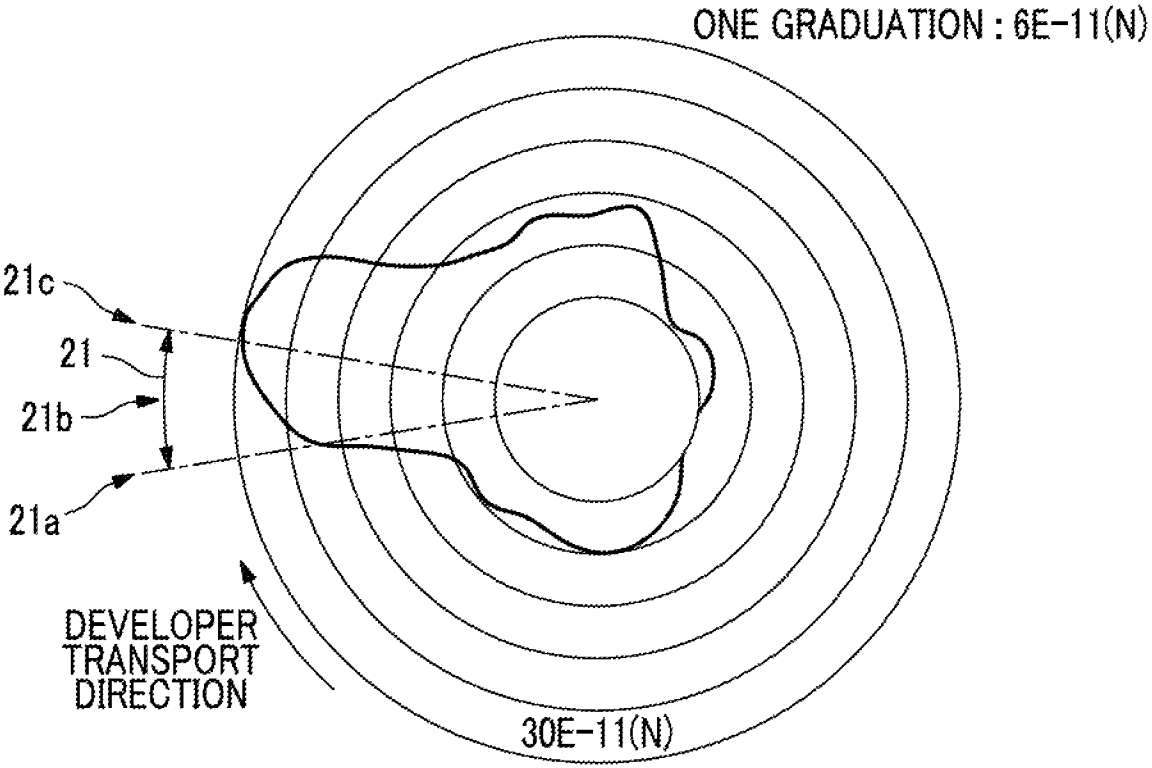

FIGS. 3A and 3B are views showing the distribution of magnetic flux density and the distribution of a magnetic attraction force on the peripheral surface of the sleeve 23*b* of the developing roll 23 of the developing device 20.

A solid line of FIG. 3A shows the distribution of magnetic flux density in the direction perpendicular to the peripheral surface of the sleeve 23*b* on the peripheral surface of the sleeve 23*b*. Further, a broken line shows the distribution of magnetic flux density in the direction along the peripheral surface of the sleeve 23*b*. Meanwhile, FIG. 3B is a view showing the distribution of a magnetic attraction force in the direction perpendicular to the peripheral surface of the sleeve 23*b* on the peripheral surface of the sleeve 23*b* (hereinafter, referred to as a "magnetic attraction force"). Further, the distribution of magnetic flux density and the distribution of a magnetic attraction force of FIGS. 4A to 9B are also the same as described above.

Meanwhile, in these drawings, a value of magnetic flux density is 0 mT on the innermost reference circle and one graduation having the shape of a concentric circle corresponds to 20 mT. Further, a value of a magnetic attraction force is 0 (N) on the innermost reference circle and one graduation having the shape of a concentric circle corresponds to 6E-11 (N). This magnetic attraction force is a component in a normal direction of a force that is applied to one magnetic carrier on the surface of the sleeve 23*b* when the particle size of the magnetic carrier is 25 μm and the magnetic permeability of the magnetic carrier is 1.007. A direction toward the center of the magnet roll 23*a* is the positive direction of the magnetic attraction force.

Five magnetic poles are magnetized on the magnet roll 23*a* of the developing roll 23 in the circumferential direction, and a developing main magnetic pole is provided on the downstream side of the developing area 21 where the sleeve 23*b* and the photoreceptor drum 1 face each other. As shown in FIG. 3A, the distribution of the magnetic flux density at the developing main magnetic pole is the distribution of magnetic flux density in the circumferential direction of the magnet roll 23*a* and is set so that a central angle α between two positions P1 and P2 corresponding to 80% of a peak value of magnetic flux density on both sides of the developing main magnetic pole is about 200.

The distribution of a magnetic attraction force on the peripheral surface of the sleeve 23*b* including the magnet roll 23*a*, which is magnetized as described above, therein is increased from an upstream end 21*a* toward a downstream end 21*c* in the rotation direction of the sleeve 23*b* shown by an arrow of FIG. 3B, that is, in the developer transport direction. Accordingly, a magnetic attraction force in the developing area 21 becomes maximum at the downstream end 21*c* in the developer transport direction. Further, an increasing gradient of a magnetic attraction force is formed so that a gradient toward a middle position 21*b* of the developing area 21 from the upstream end 21*a* is larger than a gradient toward the downstream end 21*c* from the middle position 21*b* of the developing area 21. That is, the amount of the increase of a magnetic attraction force between the upstream end 21*a* and the middle position 21*b* is larger than the amount of the increase of a magnetic attraction force between the middle position 21*b* of the developing area 21 and the downstream end 21*c*, and a magnetic attraction force is increased by 6E-11 (N) or more.

Meanwhile, in this exemplary embodiment, the peripheral surface of the photoreceptor drum 1 and the peripheral surface of the sleeve 23*b*, which face each other in the developing area 21, are rotated so as to move in the opposite directions, the upstream end 21*a* in the developer transport direction serves as an outlet when an image to be developed passes through the developing area 21, and the downstream end 21*c* in the developer transport direction serves as an inlet when the image passes through the developing area 21.

When a magnetic attraction force is rapidly increased over the middle position 21*b* from the upstream end 21*a* in the developer transport direction as described above, it is considered that developability is improved for the following reasons.

The shape of the magnetic carrier, which stands in the shape of an ear of grain, changes due to the rapid change of a magnetic attraction force between the upstream end 21*a* and the middle position 21*b* in the developer transport direction, and the magnetic carrier receives an impact. Accordingly, this impact is also transmitted to the toner that adheres to the magnetic carrier having received the impact, so that toner is separated from the magnetic carrier. As a result, toner is apt to be transferred to the image portion formed on the photoreceptor drum 1. In particular, while the two-component developer of which the magnetic carrier has received an impact on the upstream side in the developer transport direction and the toner has started to be transferred is transported toward the downstream side of the developing area 21 from the upstream side of the developing area 21, toner is apt to be transferred to the image that is formed on the photoreceptor drum 1 and moved toward the outlet of the developing area 21 from the inlet of the developing area 21.

Accordingly, it is possible to ensure developability with a developing bias voltage that is small as compared to when a magnet roll of which the variation of a magnetic attraction force is small (for example, the variation of a magnetic attraction force is smaller than 6E-11 (N)) in the developing area 21 is used.

Here, developability is evaluated as follows:

It may be evaluated that developability is more excellent when the amount of toner transferred to a predetermined image, for example, a solid image is larger in the amount of a supplied developer that is held on the developing roll 23 and transported to the developing area 21.

As for developer transportability, since a magnetic attraction force becomes maximum at the downstream end 21*c* of the developing area 21 in the developer transport direction, a transport force for transporting the two-component developer is also increased toward the downstream side. Accordingly, the retention of the magnetic carrier, which is continuously transported to the developing area 21, in the developing area 21 is suppressed, so that the magnetic carrier is transported to the outside of the developing area 21 with the rotation of the sleeve 23*b* while being adsorbed on the sleeve 23*b*. Therefore, the rubbing between the magnetic carrier and the surface of the photoreceptor drum 1, which is caused by the retention of the developer, that is, so-called deterioration of a solid image or the like is suppressed.

Figure 4A:
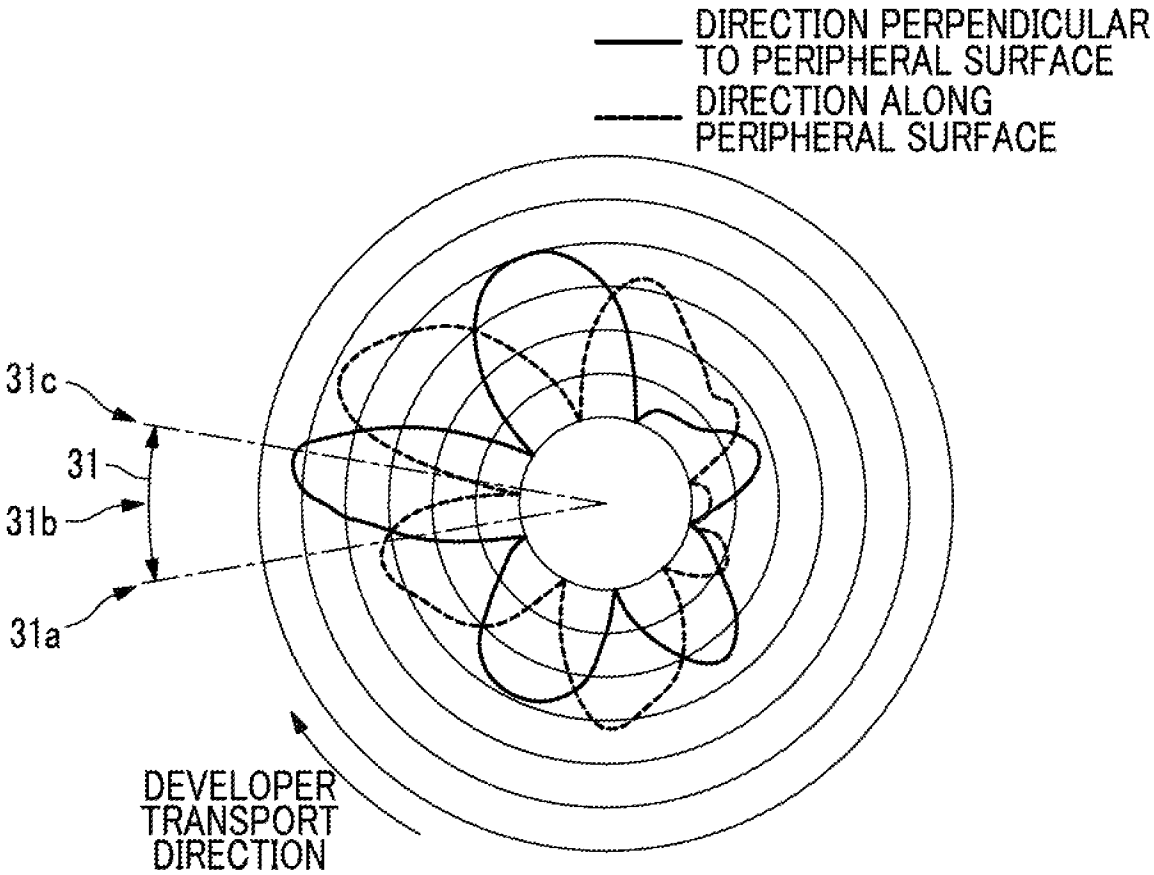
FIGS. 4A and 4B are views showing the distribution of magnetic flux density and the distribution of a magnetic attraction force on the peripheral surface of another example of the developing roll that can be used in the developing device according to the exemplary embodiment of the invention.
Figure 4B:
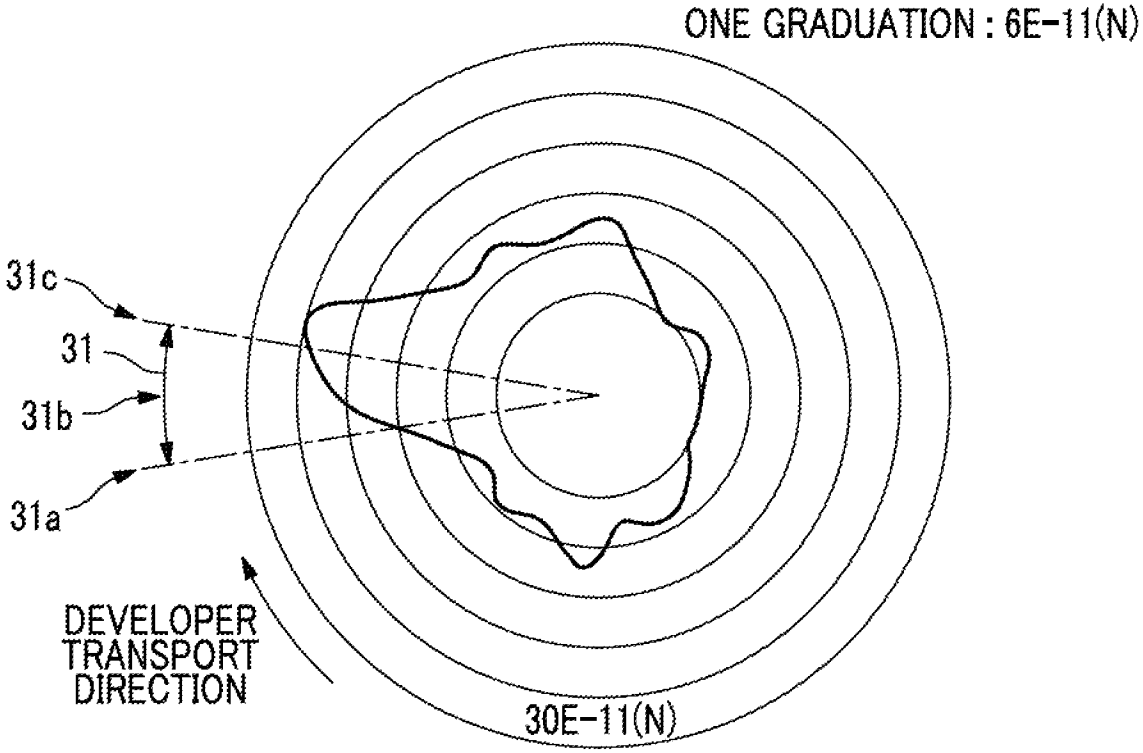

FIG. 4A is a view showing the distribution of magnetic flux density on the peripheral surface of another example of the developing roll 23 that can be used in the developing device 20 according to the exemplary embodiment of the invention, and FIG. 4B is a view showing the distribution of a magnetic attraction force of the developing roll 23.

Like the developing roll 23 that shows the distribution of magnetic flux density in FIG. 3A, this developing roll 23 has a structure where five magnetic poles are magnetized in the circumferential direction of a magnet roll 23*a*. However, the range of a developing main magnetic pole is narrower than that of the developing roll 23 shown in FIGS. 3A and 3B. That is, in the distribution of magnetic flux density in the circumferential direction of the magnet roll 23*a* of this developing roll 23, a central angle α between two positions (not shown) corresponding to 80% of a peak value of magnetic flux density on both sides of a developing main magnetic pole is set to about 15.5°.

Like the developing roll 23 shown in FIGS. 3A and 3B, the distribution of a magnetic attraction force on the developing roll 23, which has this distribution of magnetic flux density, corresponds to an increasing gradient in the range from an upstream end 31*a* to a downstream end 31*c* in the developer transport direction that is the rotation direction of a sleeve, 23*b*, and this increasing gradient is formed so that a gradient from the upstream end 31*a* to a middle position 31*b* is larger than a gradient from the middle position 31*b* to the downstream end 31*c* in the developer transport direction. Further, it is possible to increase the increasing gradient of a magnetic attraction force in a developing area 31 by reducing the width of the developing main magnetic pole, so that the amount of the increase of a magnetic attraction force between the upstream end 31*a* and the middle position 31*b* is 8E-11 (N) or more. Accordingly, a magnetic attraction force is rapidly increased as compared to the developing roll 23 showing the distribution of a magnetic flux density in FIG. 3A, so that it is possible to improve developability as compared to the developing device 20 using the magnet roll 23*a* shown in FIGS. 3A and 3B.

Meanwhile, a magnetic attraction force in the developing area 31 becomes maximum at the downstream end 31*c* in the developer transport direction, that is, at the inlet of the developing area 31 through which an image is transported on the photoreceptor drum 1. Accordingly, the retention of the two-component developer does not easily occur in the developing area 31, so that developer transportability is excellent.

Figure 5A:
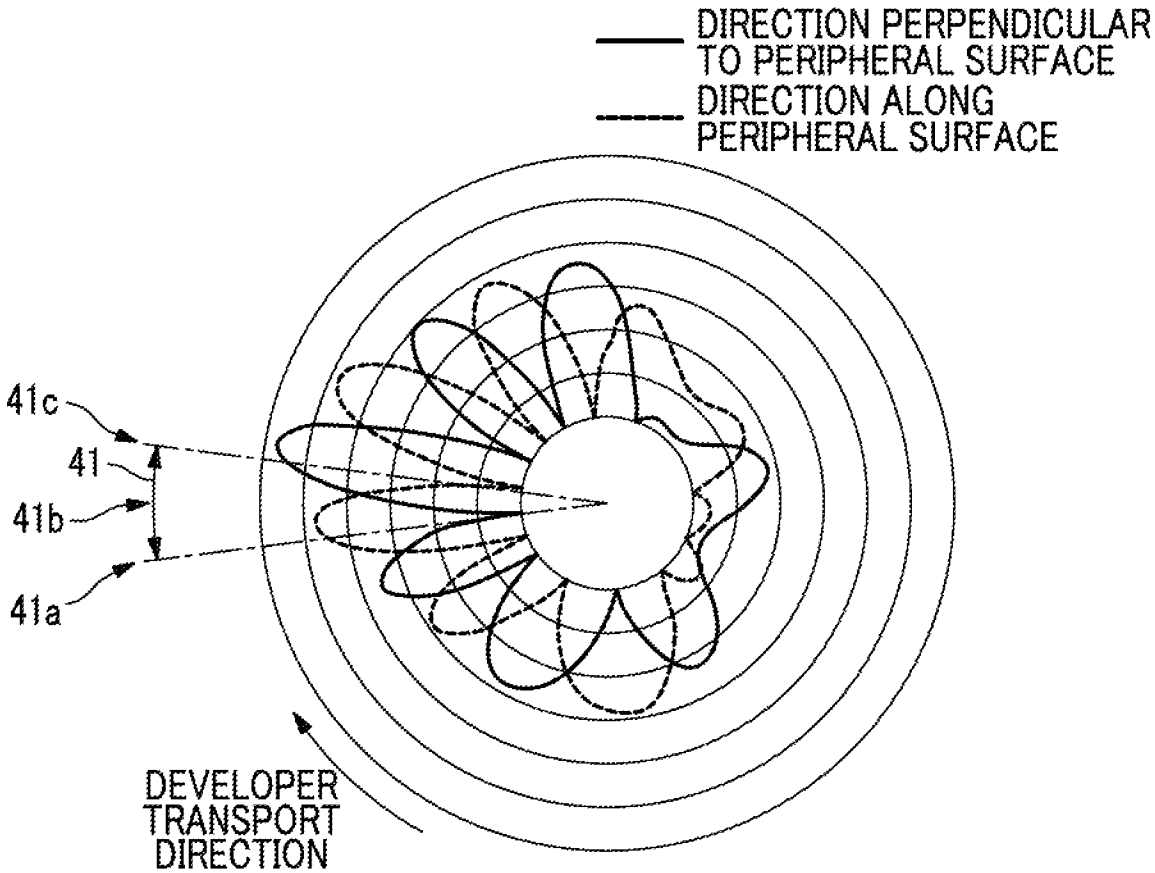
FIGS. 5A and 5B are views showing the distribution of magnetic flux density and the distribution of a magnetic attraction force on the peripheral surface of another example of the developing roll that can be used in the developing device according to the exemplary embodiment of the invention.
Figure 5B:
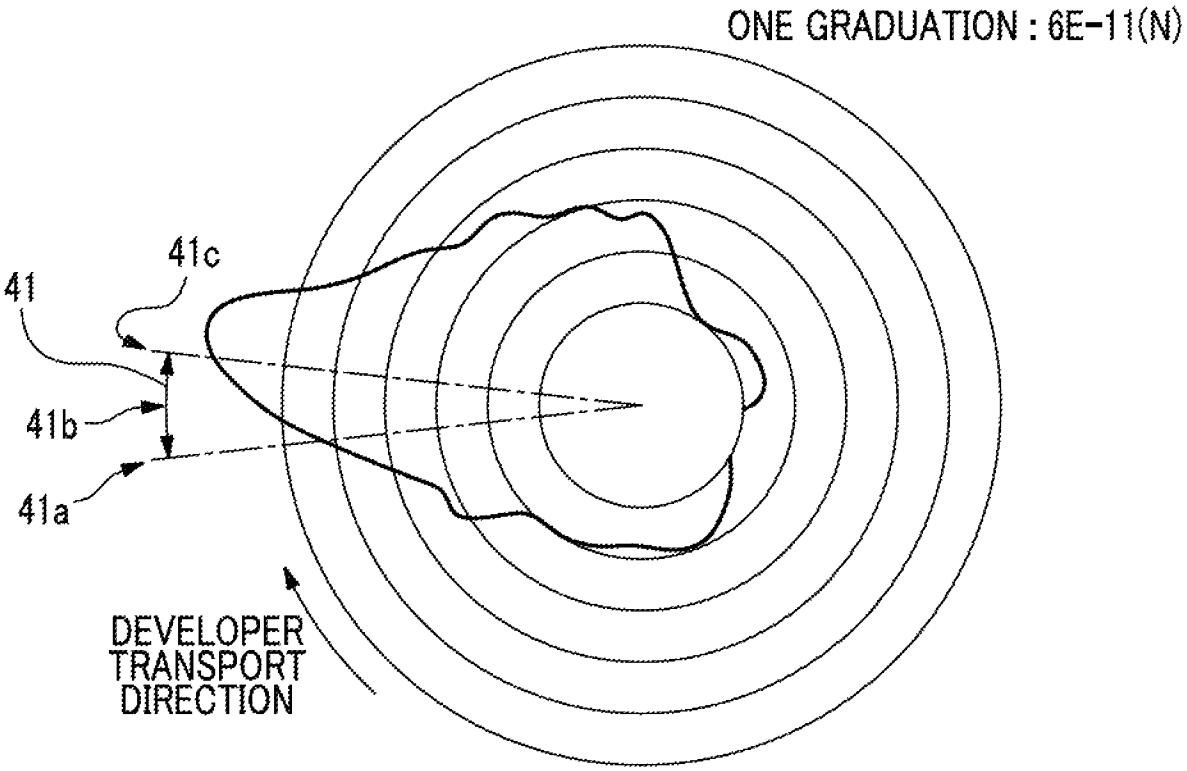

FIGS. 5A and 5B are views showing the distribution of magnetic flux density and the distribution of a magnetic attraction force on the peripheral surface of another example of the developing roll that can be used in the developing device 20 according to the exemplary embodiment of the invention.

This developing roll 23 has a structure where seven magnetic poles are magnetized in the circumferential direction of a magnet roll 23*b*, and the range of each of the magnetic poles is narrower than that of the developing roll 23 shown in FIGS. 4A and 4B. Further, in the distribution of magnetic flux density in the circumferential direction of the developing roll 23, a central angle α between two positions corresponding to 80% of a peak value of magnetic flux density on both sides of a developing main magnetic pole is about 13.7°.

On the developing roll 23, which has this distribution of magnetic flux density, the distribution of a magnetic attraction force of a developing area 41 corresponds to an increasing gradient in the range from an upstream end 41*a* to a downstream end 41*c* in the developer transport direction that is the rotation direction of a sleeve 23*b* as shown in FIG. 5B and the amount of the increase of a magnetic attraction force between the upstream end 41*a* and a middle position 41*b* is 8E-11 (N) or more.

Meanwhile, a magnetic attraction force in the developing area 41 is increased in the range from the upstream end 41*a* to the downstream end in the developer transport direction, and becomes maximum at the downstream end 41*c* in the developer transport direction, that is, at the inlet of the developing area 41.

Figure 6A:
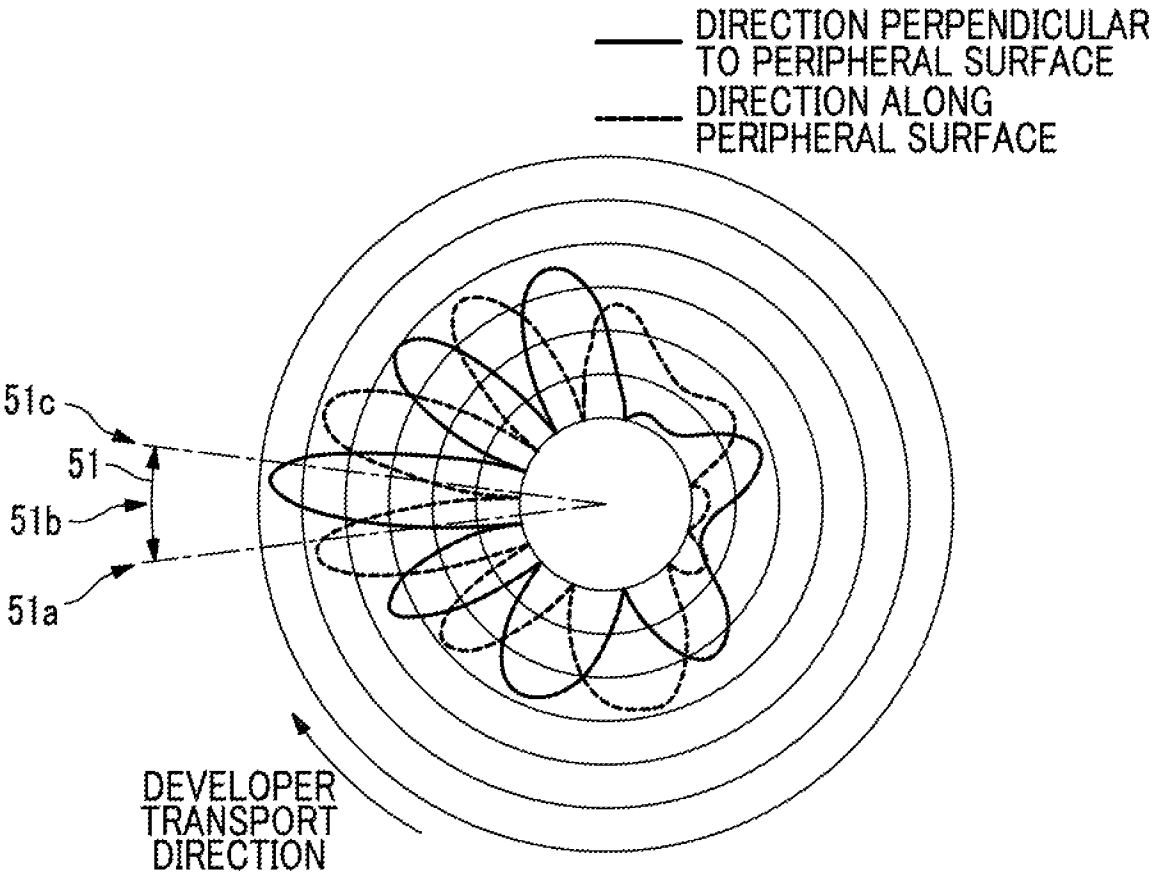
FIGS. 6A and 6B are views showing the distribution of magnetic flux density and the distribution of a magnetic attraction force on the peripheral surface of another example of the developing roll that can be used in the developing device according to the exemplary embodiment of the invention.
Figure 6B:
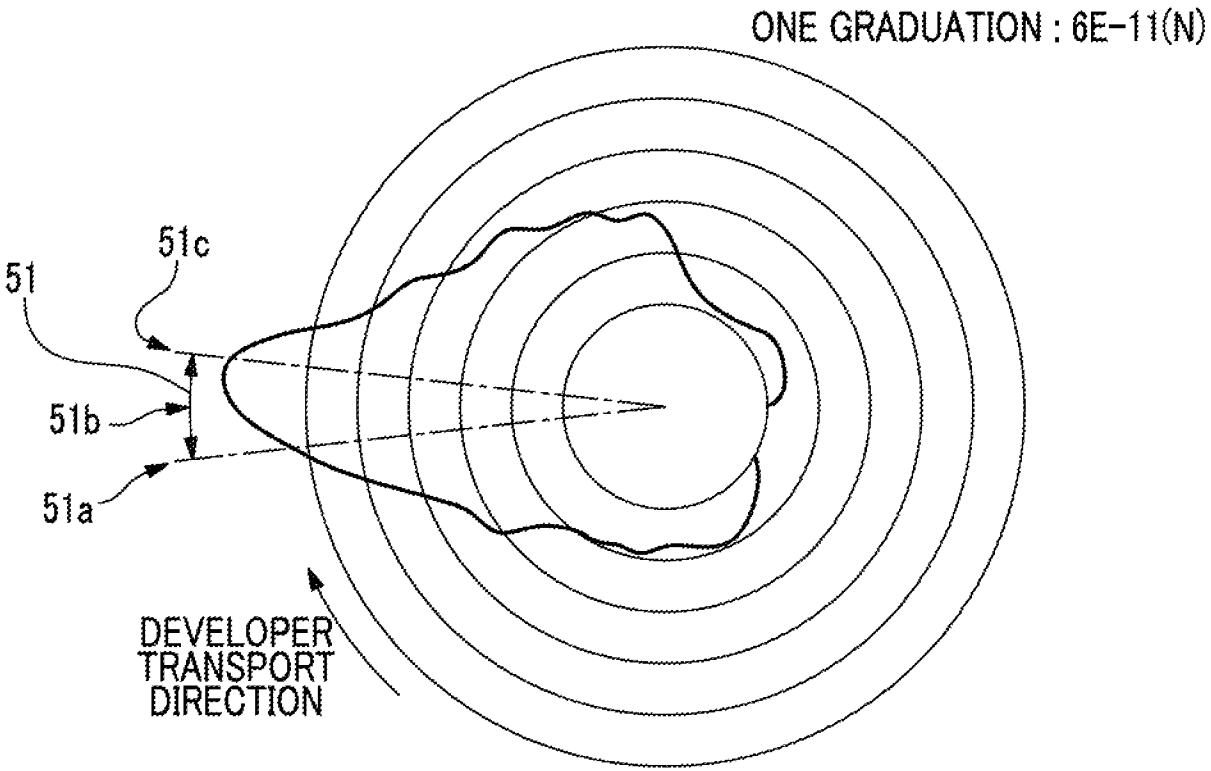

FIGS. 6A and 6B are views showing the distribution of magnetic flux density and the distribution of a magnetic attraction force on the peripheral surface of another example of the developing roll 23 that can be used in the developing device 20 according to the exemplary embodiment of the invention.

Like the developing roll 23 that shows the distribution of magnetic flux density in FIG. 5A, this developing roll 23 has a structure where seven magnetic poles are magnetized in the circumferential direction of a magnet roll 23*a*. However, a peak value of the distribution of magnetic flux density of a developing main magnetic pole is present in a developing area 51. Accordingly, a peak value of a magnetic attraction force is present near a downstream end 51*c* in the developing area 51, a value of a magnetic attraction force is increased from an upstream end 51*a* to the peak, and the value of a magnetic attraction force is reduced from the peak to the downstream end 51*c*. The amount of the increase of a magnetic attraction force between the upstream end 15*a* and a middle position 51*b* is 6E-11 (N) or more, and is larger than the amount of the increase of a magnetic attraction force between the middle position 51*b* and the peak. Further, the amount of the decrease of a magnetic attraction force between the peak and the downstream end 51*c* is about 2% of the peak value.

Even in the case of this developing roll 23, a magnetic attraction force is increased from the upstream end 51*a* of the developing area 51 in the developer transport direction to the middle position 51*b* and development efficiency is excellent as compared to a developing roll 23 where the amount of the increase of a magnetic attraction force on the upstream side of the developing area 51 is smaller than that of this developing roll 23. Further, a magnetic attraction force is reduced on the downstream side of the middle position 51*b* of the developing area 51, but the amount of a magnetic attraction force, which is reduced up to the downstream end 51*c*, is about 2% of the peak value and a high magnetic attraction force is maintained. Accordingly, the same developer transportability as that of the developing roll 23 shown in FIGS. 5A and 5B is obtained.

Next, the results of an experiment, which is performed regarding developability and developer transportability while a developing device other than the exemplary embodiment of the invention is used as a comparative example, will be described.

This experiment is an experiment that investigates developability and developer transportability of developing devices using three kinds of developing rolls A, B, and C of which the distributions of magnetic attraction forces in the direction perpendicular to the peripheral surfaces of the developing rolls on the peripheral surfaces of the developing rolls are different from each other.

With regard to developability, development is performed while the amount of a supplied developer that is held on the developing roll and transported to a developing area is changed. Further, the amount of toner transferred to a solid image is measured, and it is determined that developability is more excellent when the amount of the transferred toner, that is, the amount of development is larger.

With regard to developer transportability, development is performed while the amount of a supplied developer that is held on the developing roll and transported to the developing area is changed and the amount of toner transferred to a solid image is measured. The amount of the transferred toner is increased with the increase of the amount of the supplied developer. However, when the amount of the supplied developer is large, the amount of the transferred toner starts to be reduced despite the increase of the amount of the supplied developer. If the amount of the supplied developer is larger when the amount of the transferred toner becomes a peak, it may be determined that developer transportability is more excellent. That is, it is considered that the amount of the transferred toner is reduced when the retention of a developer occurs in the developing area and the transferred toner is scraped off due to the retention of the developer. Accordingly, it may be said that developer transportability is more excellent when the amount of the developer, which may be transported without the retention, is larger.

The three kinds of developing rolls will be described below.

Figure 7A:
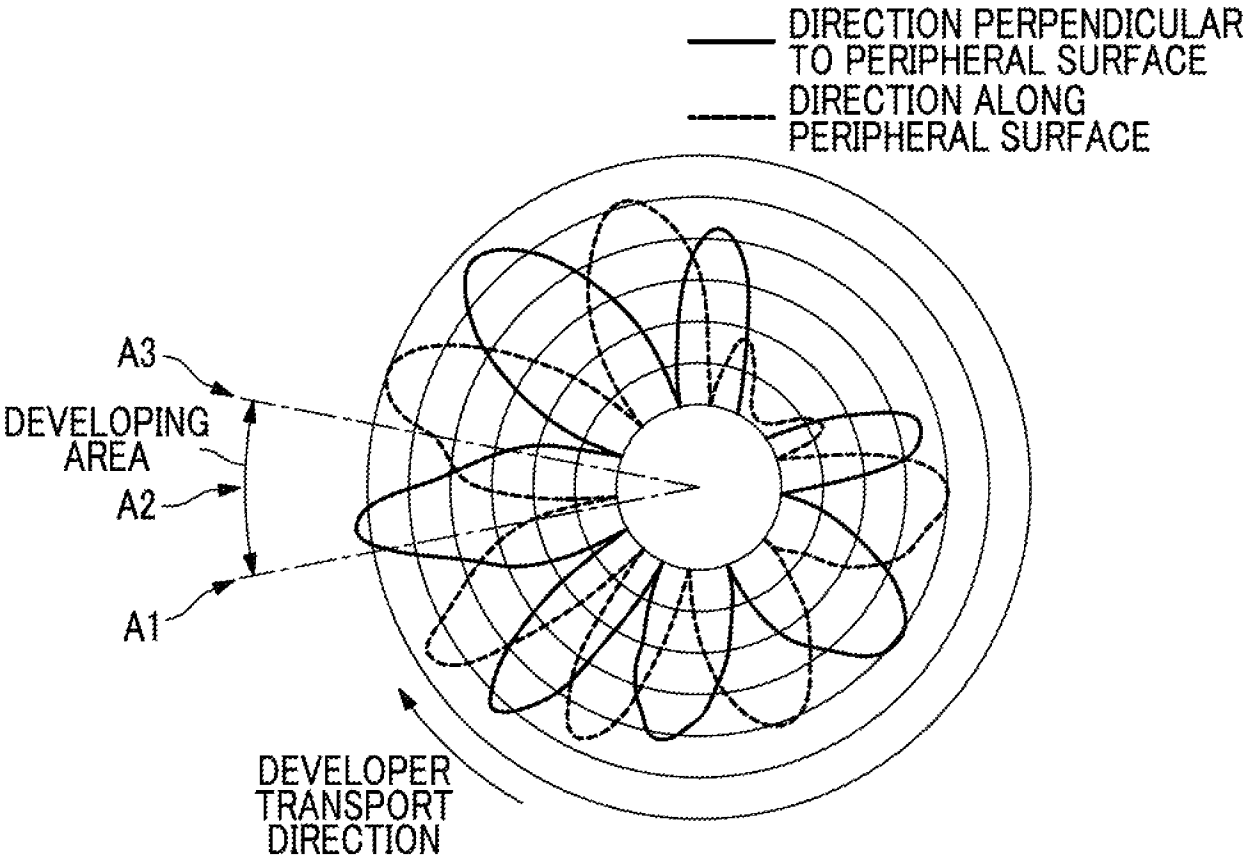
FIGS. 7A and 7B are views showing the distribution of magnetic flux density and the distribution of a magnetic attraction force on the peripheral surface of a developing roll A that is used in a developing device used in an experiment as a comparative example.
Figure 7B:
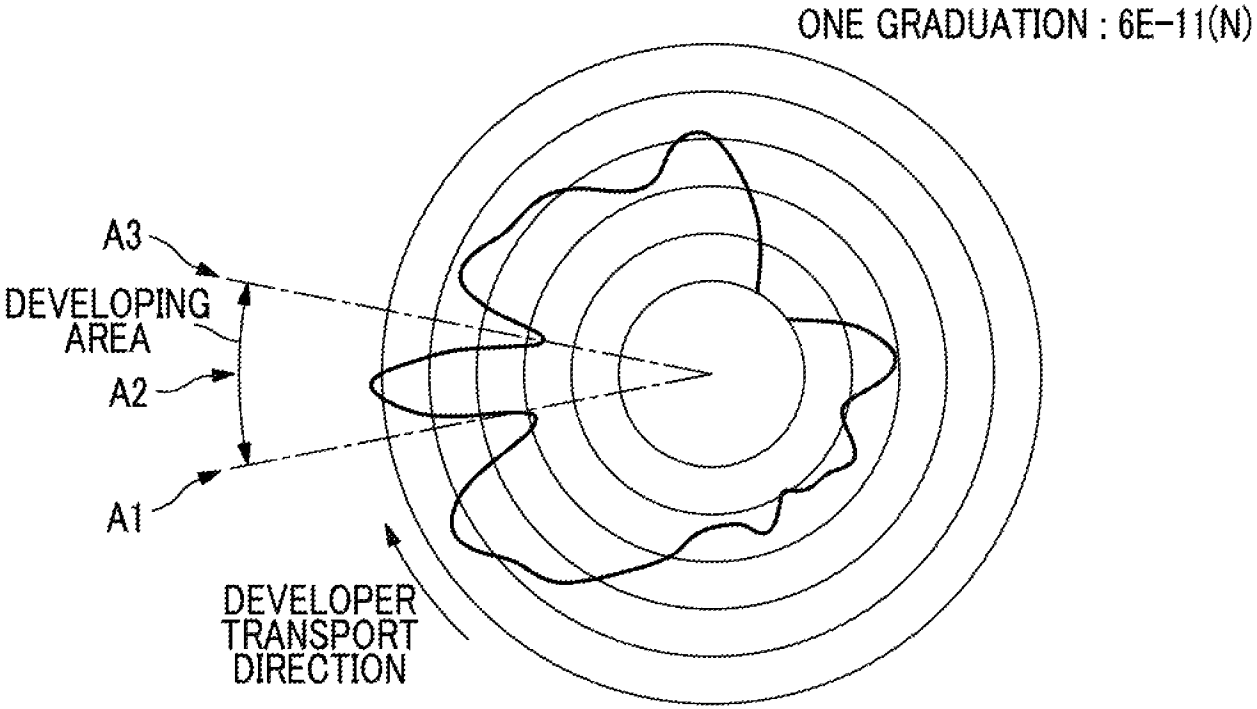

FIGS. 7A and 7B are views showing the distribution of magnetic flux density and the distribution of a magnetic attraction force of the developing roll A.

As shown in FIG. 7A, this developing roll A has a structure where seven magnetic poles are magnetized in the circumferential direction of a magnet roll and a developing main magnetic pole is magnetized so that a peak of magnetic flux density in the direction perpendicular to the peripheral surface of the developing roll is present in the developing area. Due to this magnetization, as shown in FIG. 7B, the distribution of a magnetic attraction force has a peak near a middle position A2 of a developing area and the magnetic attraction force is increased from an upstream end A1 to the peak. Further, a magnetic attraction force is significantly reduced from the peak toward a downstream end A3 in the developer transport direction, and the amount of the decrease of the magnetic attraction force is 18E-11 (N) or more.

Figure 8A:
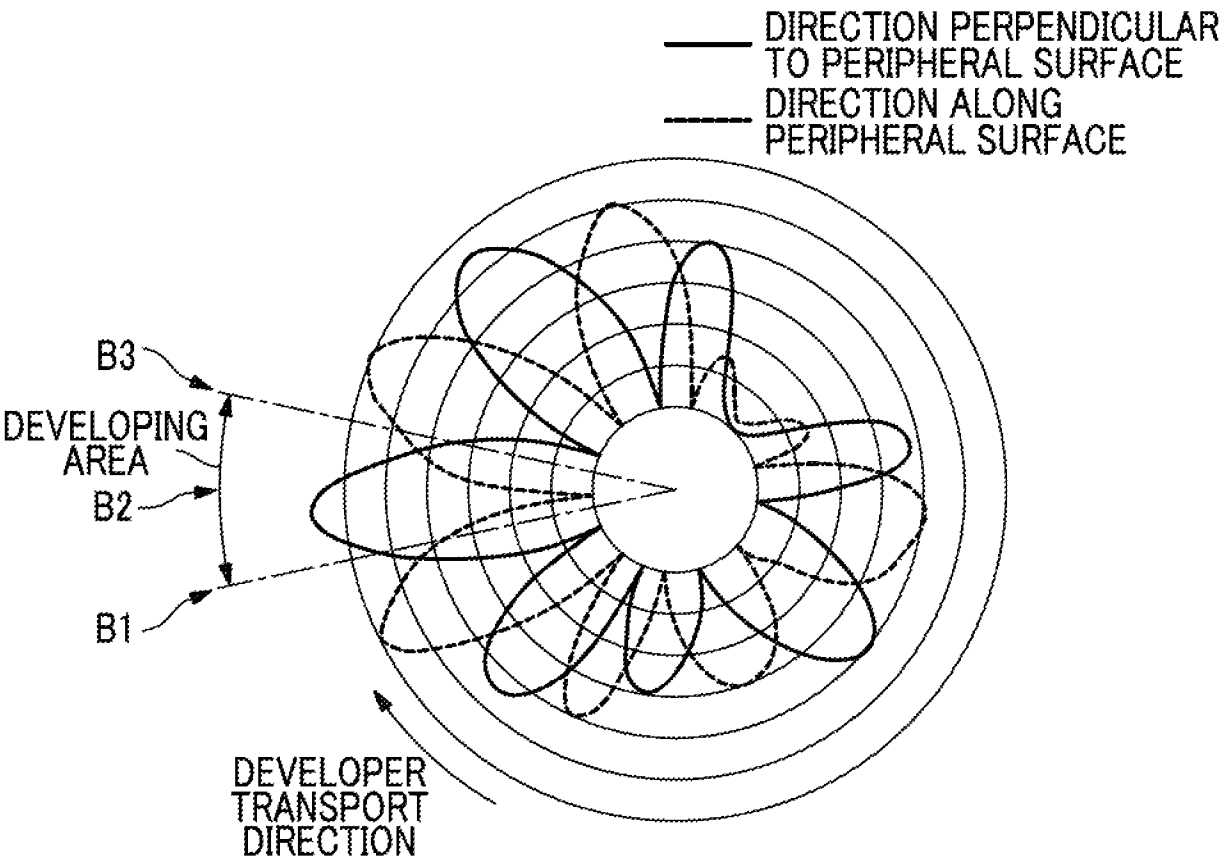
Figure 8B:
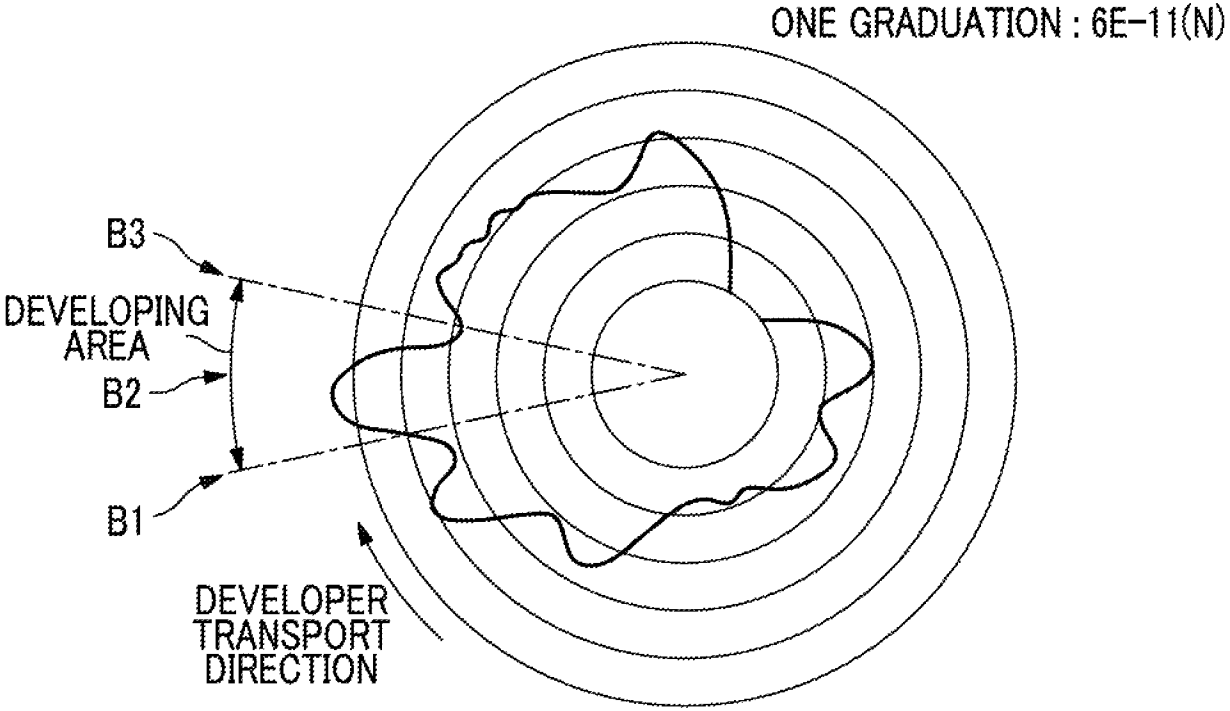

FIGS. 8A and 8B are views showing the distribution of magnetic flux density and the distribution of a magnetic attraction force of the developing roll B.

Like the developing roll A, as shown in FIG. 8A, this developing roll B has a structure where seven magnetic poles are magnetized in the circumferential direction of a magnet roll and a developing main magnetic pole is magnetized so that a peak of magnetic flux density in the direction perpendicular to the peripheral surface of the developing roll is present in the developing area. The developing main magnetic pole is magnetized in the range wider than that of the developing roll A in the circumferential direction, that is, a central angle between two positions corresponding to 80% of a peak value of magnetic flux density on both sides of the developing main magnetic pole in the distribution of magnetic flux density is larger than that of the developing roll A.

As shown in FIG. 8B, the distribution of a magnetic attraction force of the developing roll B has a peak near a middle position B2 of a developing area in the developer transport direction and the magnetic attraction force is increased from an upstream end B1 to the peak in the developer transport direction. However, this increasing gradient is smaller than that of the developing roll A. Further, the amount of the decrease of a magnetic attraction force between the peak and a downstream end B3 in the developer transport direction is also smaller than that of the developing roll A.

Figure 9A:
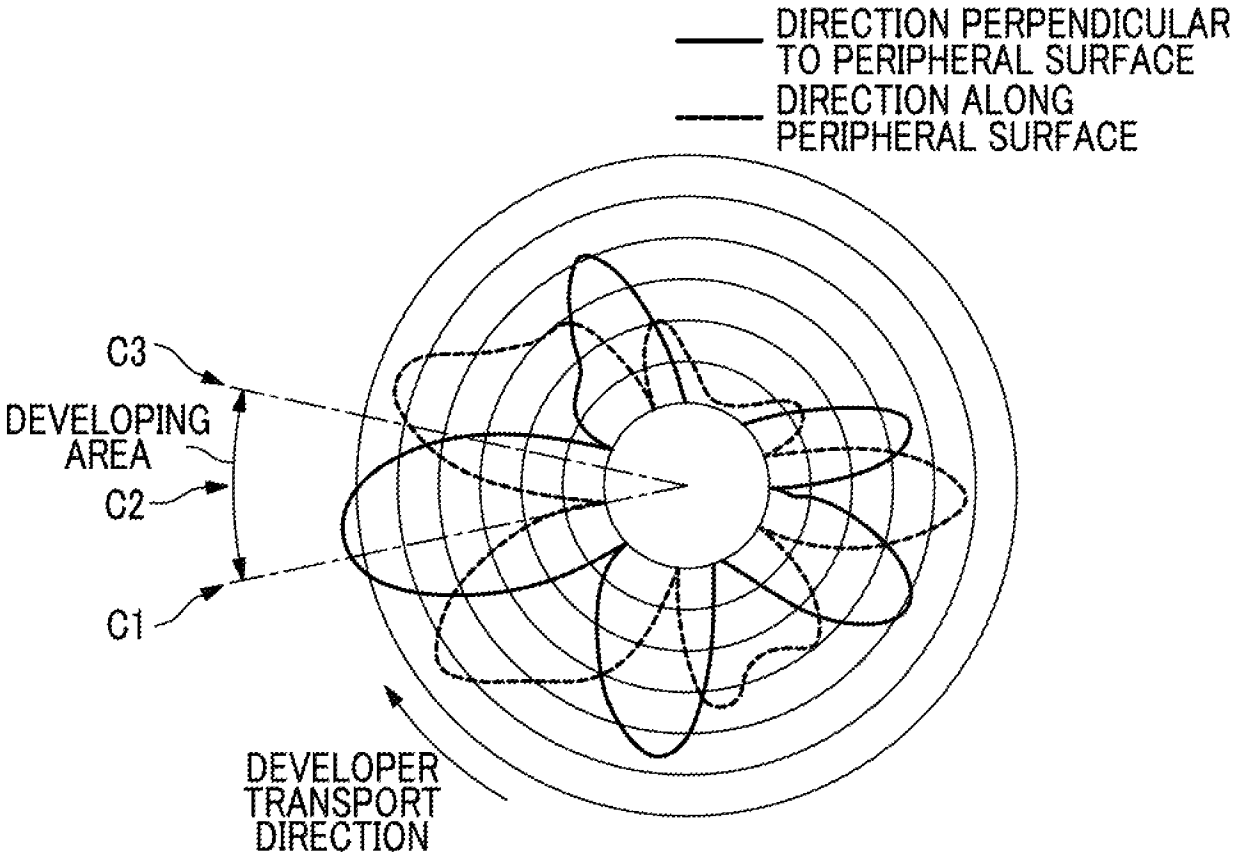
FIGS. 9A and 9B are views showing the distribution of magnetic flux density and the distribution of a magnetic attraction force on the peripheral surface of a developing roll C that is used in a developing device used in the experiment as a comparative example.
Figure 9B:
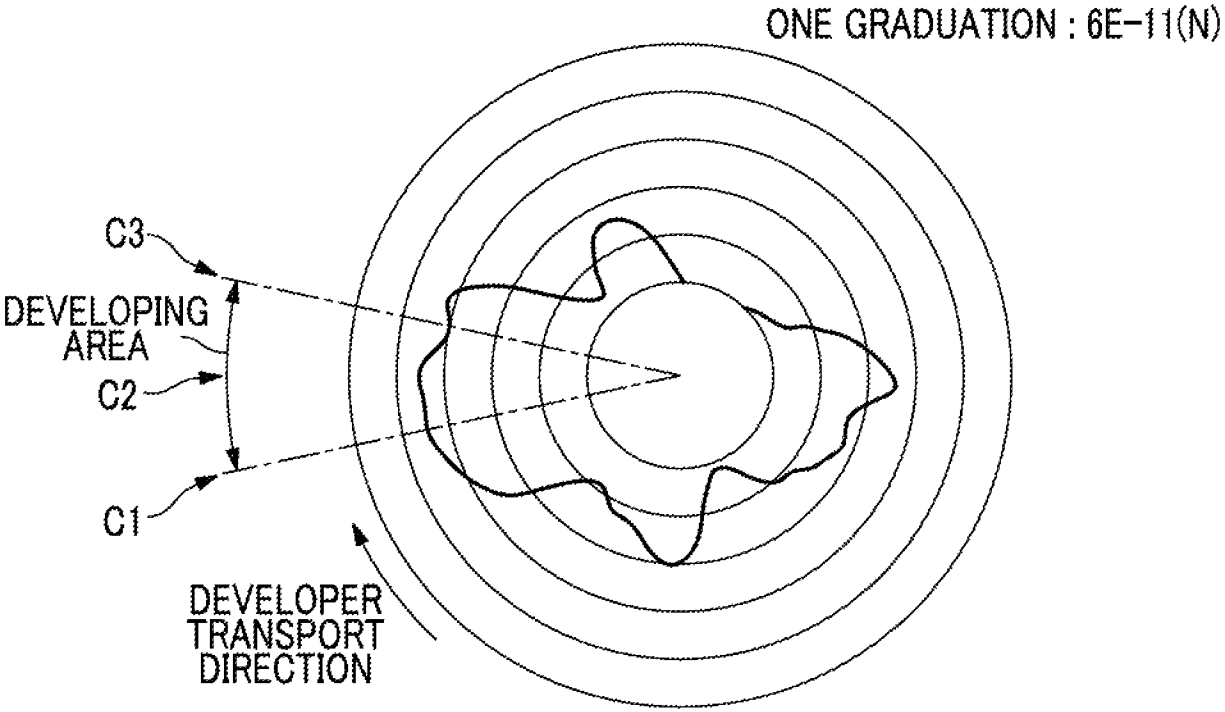

FIGS. 9A and 9B are views showing the distribution of magnetic flux density and the distribution of a magnetic attraction force of the developing roll C.

As shown in FIG. 9A, this developing roll C has a structure where five magnetic poles are magnetized in the circumferential direction of a magnet roll and a developing main magnetic pole is magnetized so that a peak of magnetic flux density in the direction perpendicular to the peripheral surface of the developing roll is present in the developing area. Moreover, the developing main magnetic pole is magnetized in the range wider than that of the developing roll B in the circumferential direction.

As shown in FIG. 9B, the distribution of a magnetic attraction force of the developing roll C has a peak near a middle position C2 of a developing area in the developer transport direction and the magnetic attraction force is increased from an upstream end C1 to the peak in the developer transport direction. The amount of the increase of the magnetic attraction force is smaller than that of the developing roll A or B, and is 2E-11 (N) or less. Further, the amount of the decrease of a magnetic attraction force between the peak and a downstream end C3 in the developer transport direction is smaller those that of the developing rolls A and B, and the magnetic attraction force at the downstream end C3 is about 90% of the peak value.

Figure 10:
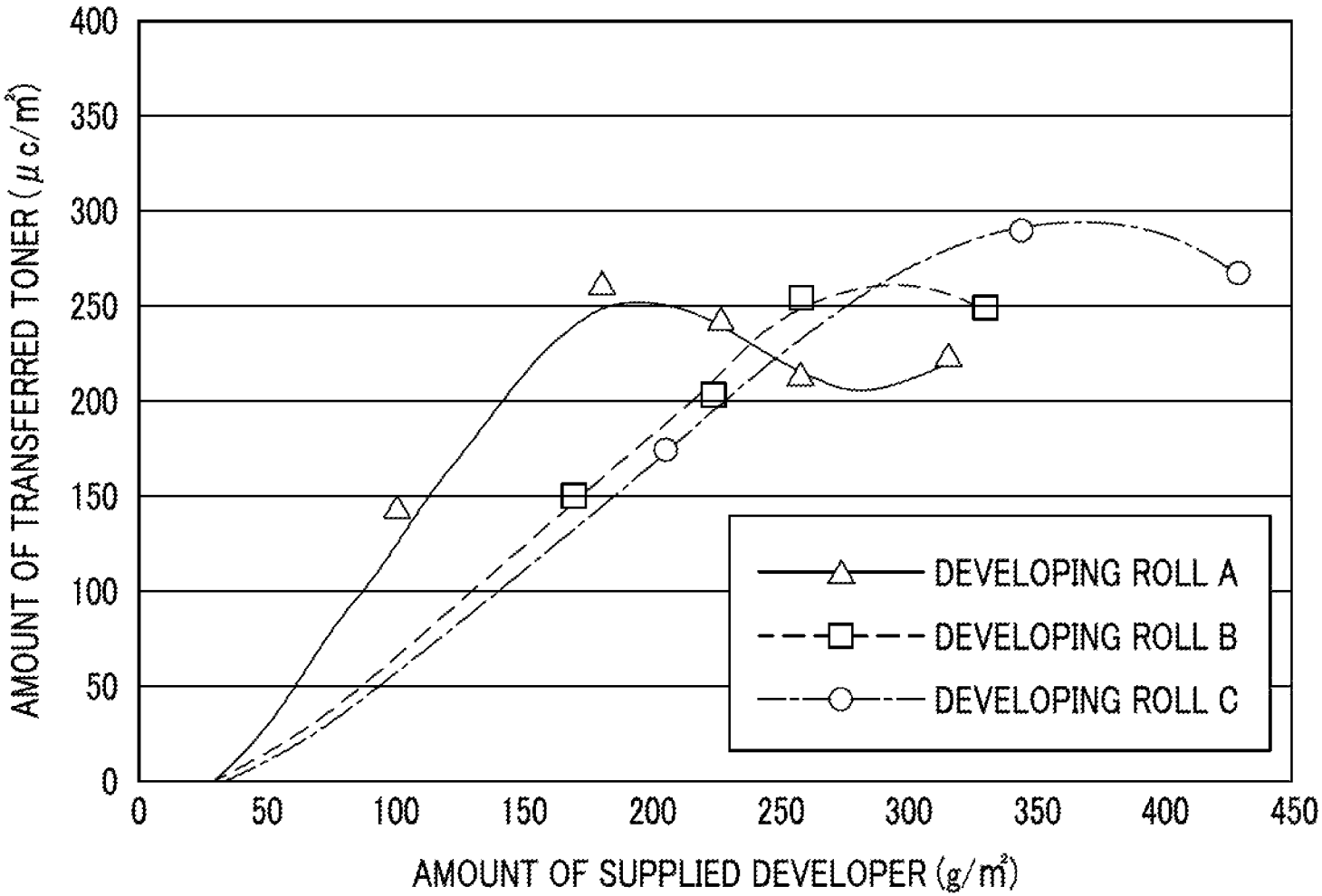
FIG. 10 is a view showing the results of the experiment that measures the amount of transferred toner while the amount of a supplied developer is changed in the developing device of the comparative example.

FIG. 10 is a view showing the results of the experiment that measures the amount of transferred toner while the amount of a supplied developer is changed in each of the three kinds of developing rolls. A horizontal axis of FIG. 10 represents the amount of a supplied developer and a vertical axis of FIG. 10 represents the amount of transferred toner, and the amount of transferred toner means the amount of electric charge of transferred toner per unit area.

In the developing device using the developing roll A, as shown in FIG. 10, the amount of transferred toner is about 250 $\mu c/m^2$ when the amount of a supplied developer is about 180 $g/m^2$, and the amount of transferred toner has an increasing gradient that is larger than those of the developing device using the developing roll B and the developing device using the developing roll C. That is, it is shown that developability is larger. Meanwhile, since the amount of transferred toner is reduced when the amount of a supplied developer exceeds 200 $g/m^2$, it is found that the amount of toner scraped off from the photoreceptor drum due to the retention of a developer is increased.

In the developing device using the developing roll B, the amount of transferred toner has a peak of about 250 $\mu c/m^2$ when the amount of a supplied developer is about 280 $g/m^2$, and this increasing gradient is smaller than that of the developing device using the developing roll A. Further, the amount of transferred toner is reduced after the peak, so that the retention of a developer occurs. Accordingly, it is found that developability is poor but developer transportability is excellent in comparison with the developing device using the developing roll A.

In the developing device using the developing roll C, when the amount of a supplied developer is about 370 $g/m^2$, the amount of transferred toner has a peak of about 290 $\mu c/m^2$ and an increasing gradient is smallest. Further, the amount of development is reduced after about 370 $g/m^2$, so that developer transportability starts to deteriorate. That is, in terms of developer transportability, the developing device using the developing roll C is superior to the developing device using the developing roll A and the developing device using the developing roll B.

The following characteristics regarding developability and developer transportability may be understood from the results of this experiment.

Developability is excellent in the developing device using the developing roll A of which a magnetic attraction force is significantly increased on the upstream side of the developing area of the developing roll in the developer transport direction, and developability is poor in the developing device using the developing roll C of which the variation of a magnetic attraction force is small on the upstream side of the developing area even though a large magnetic attraction force is maintained. Accordingly, it is found that excel lent developability is obtained when a magnetic attraction force is significantly changed on the upstream side of the developing area in the developer transport direction.

Meanwhile, in terms of developer transportability, developer transportability is poor in the developing devices using the developing rolls A and B of which magnetic attraction forces are significantly reduced on the downstream side of the developing area of the developing roll in the developer transport direction, and excellent developer transportability is obtained in the developing device using the developing roll C of which a large magnetic attraction force is maintained. Further, in the developing device using the developing roll B of which the amount of the decrease of a magnetic attraction force on the downstream side of the developing area is smaller than that of the developing roll A, developer transportability is excellent as compared to the developing device using the developing roll A. Accordingly, it is found that excellent developer transportability is obtained when a large magnetic attraction force is maintained on the downstream side of the developing area in the developer transport direction.

In addition, since it is considered that a transport force for transporting a developer is increased by the increase of a magnetic attraction force, it is preferable that the distribution of a magnetic attraction force be formed so that a magnetic attraction force is increased in the developing area toward the downstream side in the developer transport direction. However, as in the case of the developing roll C, it is found that excellent developer transportability is maintained when the amount of the decrease of a magnetic attraction force on the downstream side in the developing area is 90% of a peak value.

The developing device and the image forming apparatus, which have been described above, are exemplary embodiments of the invention, and the invention is not limited to the above-mentioned exemplary embodiments and may be embodied as other exemplary embodiments in the scope of the invention.

For example, the distribution of a magnetic attraction force and the distribution of magnetic flux density of the developing roll that are described in the above-mentioned exemplary embodiments are illustrative, and may be other distributions in the scope of the invention.

Further, a so-called against system where the rotation direction of the photoreceptor drum is opposite to the rotation direction of the sleeve, that is, the peripheral surfaces of the photoreceptor drum and the sleeve, which face each other in the developing area, move in the directions opposite to each other has been employed in the exemplary embodiment. The invention may be effectively applied to an against-type image forming apparatus or a developing device that develops an electrostatic latent image by an against system. However, the invention may be applied to an image forming apparatus where peripheral surfaces facing each other move in the same direction or a developing device that develops an electrostatic latent image formed on a photoreceptor drum moving in the same direction.

Moreover, a so-called trickle-type developing device, which performs the replenishment and recovery of a two-component developer including toner and a magnetic carrier, has been used as the developing device but the developing device is not limited to the trickle-type developing device. The developing device may be a developing device that performs the replenishment of only toner or separately performs the replenishment of toner and the replenishment of a magnetic carrier.

Further, the number of magnetic poles, which are magnetized on the magnet roll of the developing roll, is not limited to five or seven.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing member including a magnet member on which a plurality of magnetic poles including a developing main magnetic pole are arranged and magnetized in a circumferential direction, and a cylindrical developer holder that is disposed so as to face an image supporting member, receives the magnet member, and holds to transport a developer, wherein a distribution of a magnetic attraction force, which is applied on a peripheral surface of the developer holder in a developing area in a direction perpendicular to the peripheral surface by the magnet member, in a circumferential direction has a gradient that increases toward a downstream end from an upstream end of the developing area in a developer transport direction of the developer holder, and the plurality of magnetic poles are magnetized on the magnet member so that the amount of the increase of the magnetic attraction force between the upstream end of the developing area and a middle position of the developing area is larger than the amount of the increase of the magnetic attraction force between the middle position and the downstream end.

2. The developing device according to claim 1, wherein the magnet member includes the developing main magnetic pole in the developing area or on the downstream side of the middle position of the developing area in the developer transport direction of the developer holder, and the developing main magnetic pole is magnetized on the magnet member so that a central angle of the magnet member corresponding to a range where the distribution of magnetic flux density, which is generated on a peripheral surface of the magnet member in a direction perpendicular to the peripheral surface, in a circumferential direction becomes 80% or more of a peak value of the developing main magnetic pole is 16° or less.

3. An image forming apparatus comprising:

an image carrier where a latent image is formed;

a developer storage chamber in which a two-component developer including toner and a magnetic carrier is stored;

a developing device that develops the latent image formed on the image carrier by toner; and a transfer device that directly transfers the toner image to a recording medium to be transported or transfers the toner image to a recording medium to be transported after transferring the toner image to an intermediate transfer member once, wherein the developing device is the developing device according to claim 1.

4. A developing device comprising:

a developing member including a magnet member on which a plurality of magnetic poles including a developing main magnetic pole are arranged and magnetized in a circumferential direction, and a cylindrical developer holder that is disposed so as to face an image supporting member, receives the magnet member, and holds to transport a developer, wherein a distribution of a magnetic attraction force, which is applied on a peripheral surface of the developer holder in a developing area in a direction perpendicular to the peripheral surface by the magnet member, in a circumferential direction has a peak between a middle position and a downstream end of the developing area in a developer transport direction of the developer holder and has a gradient that increases to the middle position of the developing area from an upstream end of the developing area, and the plurality of magnetic poles are magnetized on the magnet member so that a magnetic attraction force at the downstream end is 90% or more of a magnetic attraction force at the peak.

5. The developing device according to claim 4, wherein the magnet member includes the developing main magnetic pole in the developing area or on the downstream side of the middle position of the developing area in the developer transport direction of the developer holder, and the developing main magnetic pole is magnetized on the magnet member so that a central angle of the magnet member corresponding to a range where the distribution of magnetic flux density, which is generated on a peripheral surface of the magnet member in a direction perpendicular to the peripheral surface, in a circumferential direction becomes 80% or more of a peak value of the developing main magnetic pole is 16° or less.

* * * * *